US008459669B2

(12) United States Patent
Lin

(10) Patent No.: US 8,459,669 B2
(45) Date of Patent: Jun. 11, 2013

(54) SKATEBOARD

(76) Inventor: Henkel Lin, Taichung (TW)

( * ) Notice: Subject to any disclaimer, the term of this patent is extended or adjusted under 35 U.S.C. 154(b) by 126 days.

(21) Appl. No.: 13/165,788

(22) Filed: Jun. 22, 2011

(65) Prior Publication Data

US 2012/0326403 A1 Dec. 27, 2012

(51) Int. Cl.
*B62M 1/00* (2010.01)

(52) U.S. Cl.
USPC ..... 280/87.042; 280/87.041; 280/87.021

(58) Field of Classification Search
USPC ..... 280/87.01, 87.021, 87.03, 87.041, 280/87.042
See application file for complete search history.

(56) References Cited

U.S. PATENT DOCUMENTS 5,347,681 A * 9/1994 Wattron et al. ..... 16/30
6,193,249 B1 * 2/2001 Buscaglia ..... 280/87.042
6,481,724 B1 * 11/2002 Whipp ..... 280/7.13
6,979,007 B1 * 12/2005 Hosoda ..... 280/87.042
7,007,977 B1 * 3/2006 Gallagher ..... 280/809
8,075,006 B2 * 12/2011 Smith ..... 280/87.042
2002/0089130 A1 * 7/2002 Cassel ..... 280/11.27
2006/0006622 A1 * 1/2006 Gesmer et al. ..... 280/87.042
2007/0114743 A1 * 5/2007 Chen ..... 280/87.042
2009/0066150 A1 * 3/2009 O'Rourke, Sr. ..... 301/5.23
2009/0200764 A1 * 8/2009 Jang et al. ..... 280/87.042
2009/0295111 A1 * 12/2009 O'Rourke ..... 280/86.751
2010/0117317 A1 * 5/2010 Smith ..... 280/87.042
2010/0289237 A1 * 11/2010 Smith ..... 280/87.042
2011/0232028 A1 * 9/2011 Lee ..... 16/45
2012/0086181 A1 * 4/2012 Kinnaman ..... 280/87.042

* cited by examiner

*Primary Examiner* — Katy M Ebner
*Assistant Examiner* — Travis Coolman

(57) ABSTRACT

A skateboard includes a deck, a rear assembly and a front assembly. The rear assembly is attached to the deck. The front assembly includes a base plate, a friction-resistant plate, a hanger, a front wheel, a baring and a king pin. The base plate is attached to the deck, made of a plastic material, and formed with an inclined face. The friction-resistant plate is made of a friction-resistant metal material and located against the inclined face. The hanger includes a ring and two branches extending from the ring. The front wheel is attached to the branches. The bearing is located in the ring. The king pin is inserted in the bearing located in the ring, the friction-resistant plate and the base plate so that the axis of the king pin extends downward and toward the rear assembly.

6 Claims, 5 Drawing Sheets

SKATEBOARD

BACKGROUND OF INVENTION

1. Field of Invention

The present invention relates to a skateboard and, more particularly, to a skateboard including two rear wheels and a single front wheel that can smoothly be steered.

2. Related Prior Art

Referring to FIG. 5, a conventional skateboard includes a deck 4, a rear assembly 5 attached to the bottom of the deck 4, a front assembly 6 attached to the bottom of the deck 4, a post attached to the top of the deck 4, and a handle connected to the post. The rear assembly 5 includes two rear wheels 50 attached to a rear truck 51 attached to the bottom of the deck 4. The front assembly 6 includes a front wheel 60 attached to a front truck 61 attached to the bottom of the deck 4. In detail, the front truck 61 includes a base plate attached to the bottom of the deck 4, a hanger or fork for supporting the front wheel 60, and a king pin for pivotally connecting the hanger to the base plate. The steering of the front assembly 6 is however not smooth because the axis of the king pin extends perpendicular to a plane in which the deck 4 lays.

The present invention is therefore intended to obviate or at least alleviate the problems encountered in prior art.

SUMMARY OF INVENTION

It is the primary objective of the present invention to provide a skateboard that can smoothly be steered.

To achieve the foregoing objective, the skateboard includes a deck, a rear assembly and a front assembly. The rear assembly is attached to the deck. The front assembly includes a base plate, a friction-resistant plate, a hanger, a front wheel, a baring and a king pin. The base plate is attached to the deck, made of a plastic material, and formed with an inclined face. The friction-resistant plate is made of a friction-resistant metal material and located against the inclined face. The hanger includes a ring and two branches extending from the ring. The front wheel is attached to the branches. The bearing is located in the ring. The king pin is inserted in the bearing located in the ring, the friction-resistant plate and the base plate so that the axis of the king pin extends downward and toward the rear assembly.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
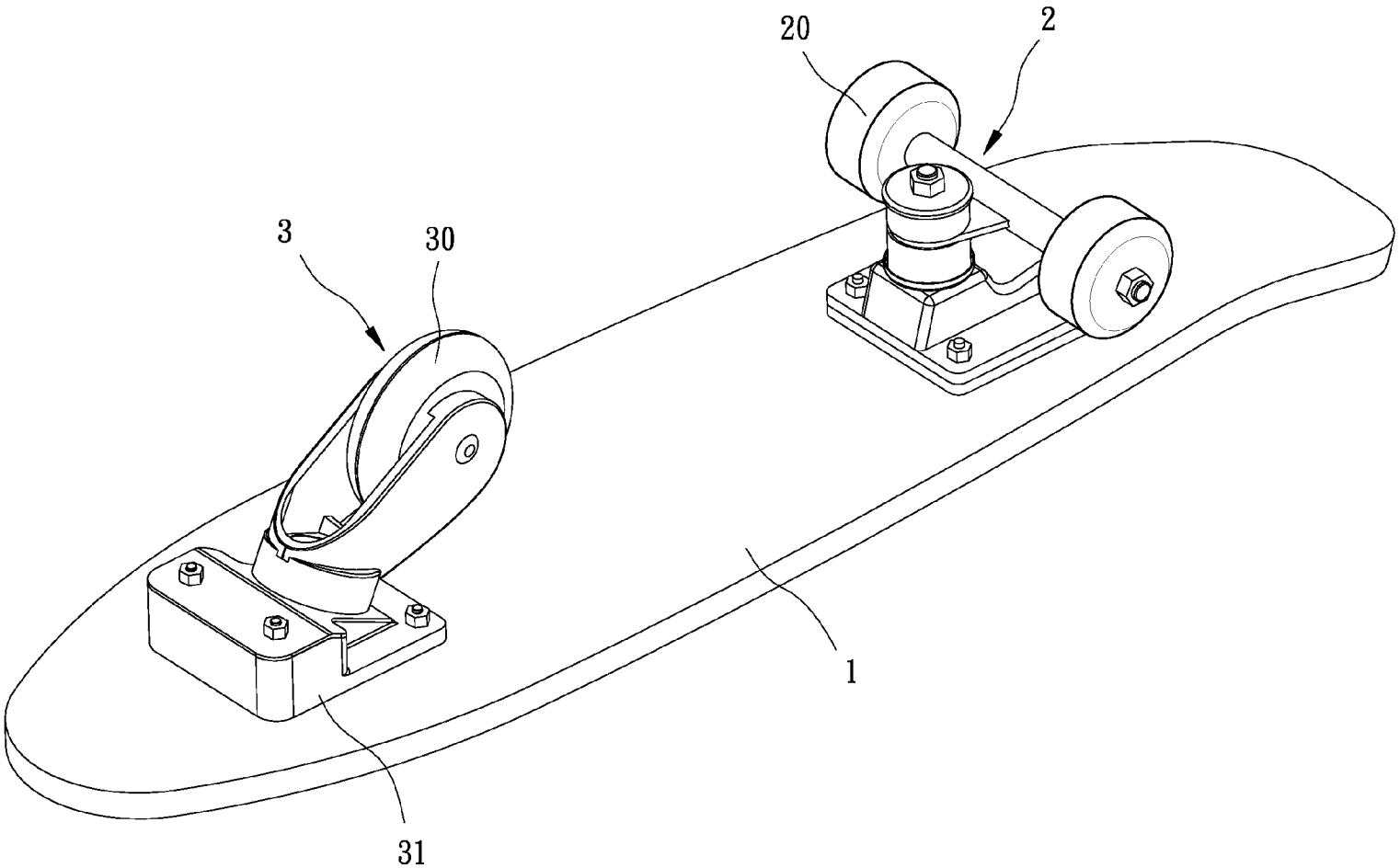
FIG. 1 is a perspective view of a skateboard in an inverted position according to the preferred embodiment of the present invention.
Figure 2:
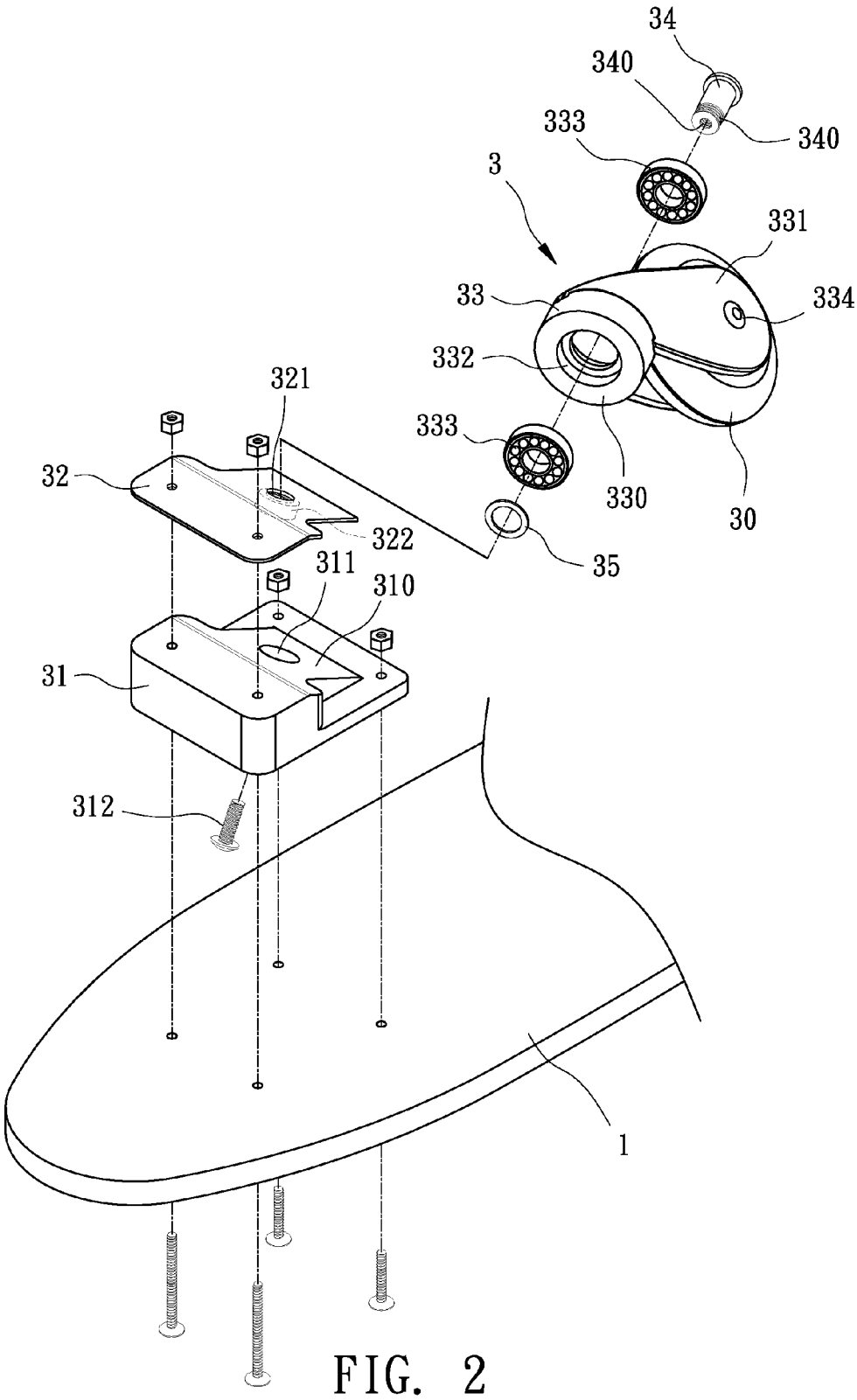
FIG. 2 is an exploded view of a front gear used in the skateboard shown in FIG. 1.
Figure 3:
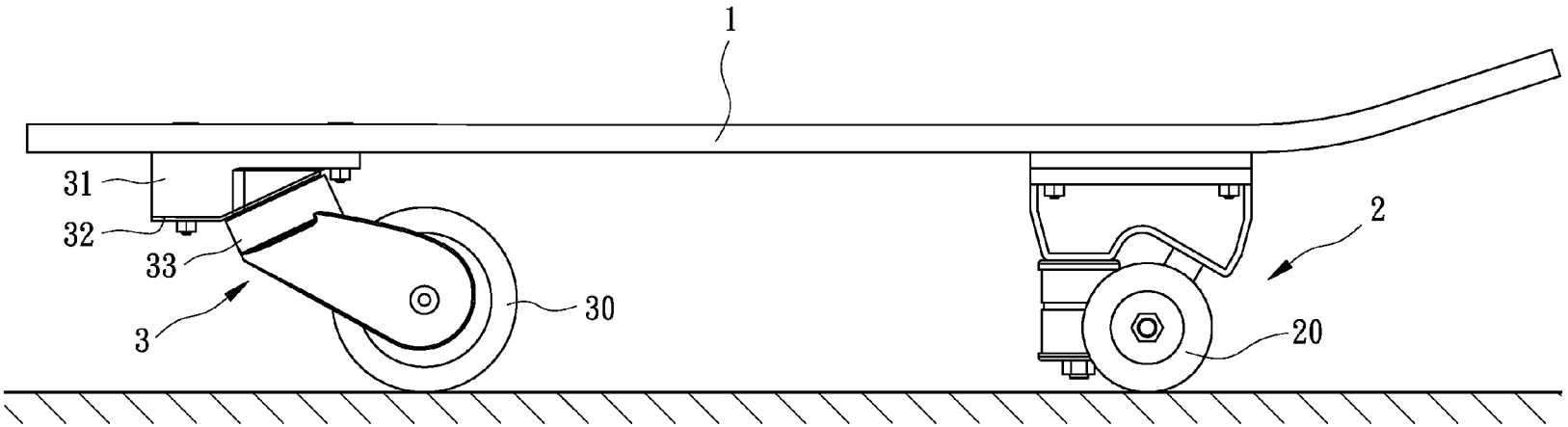
FIG. 3 is a side view of the skateboard shown in FIG. 1.
Figure 4:
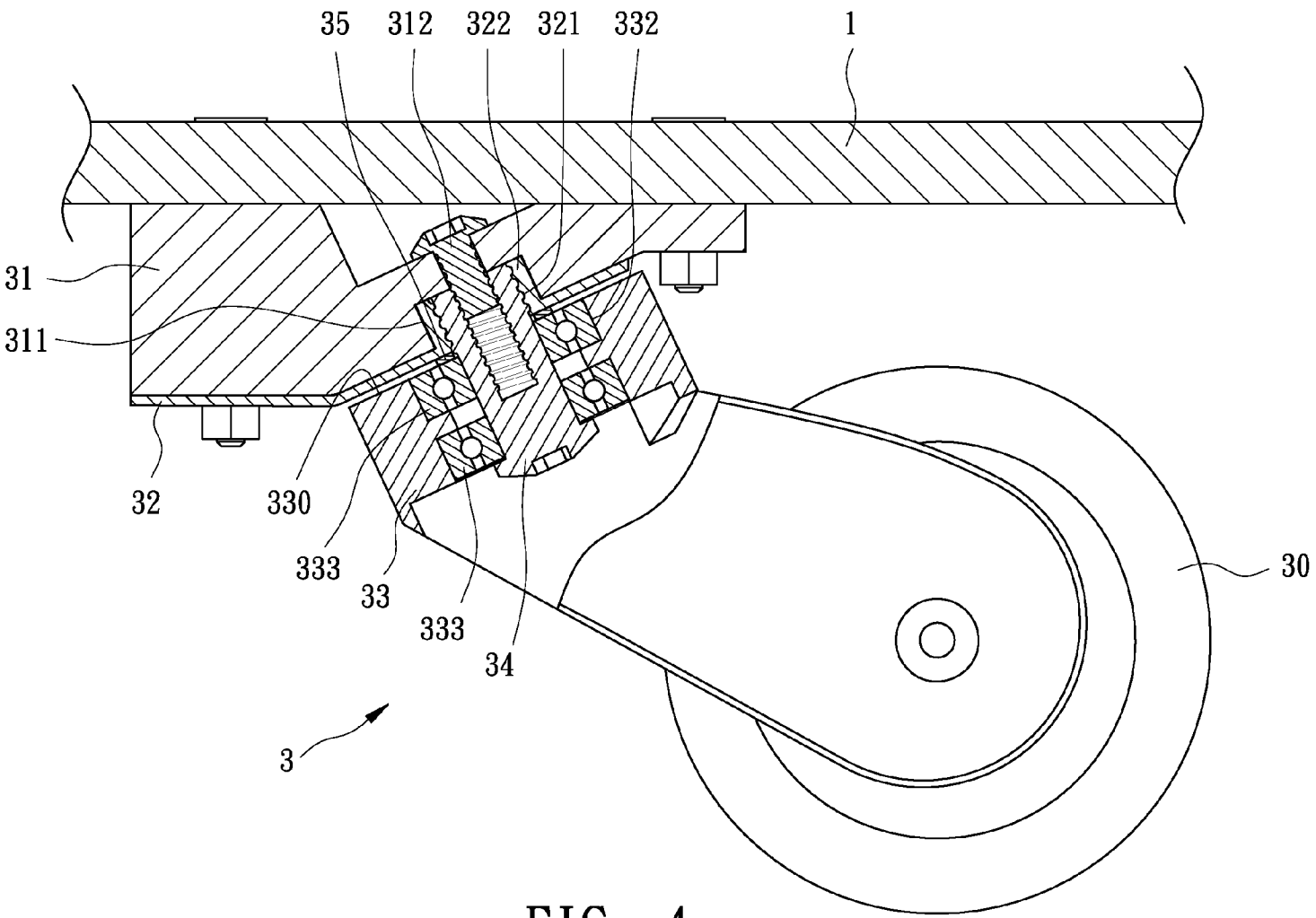
FIG. 4 is a cross-sectional view of the front gear of the skateboard shown in FIG. 1.
Figure 5:
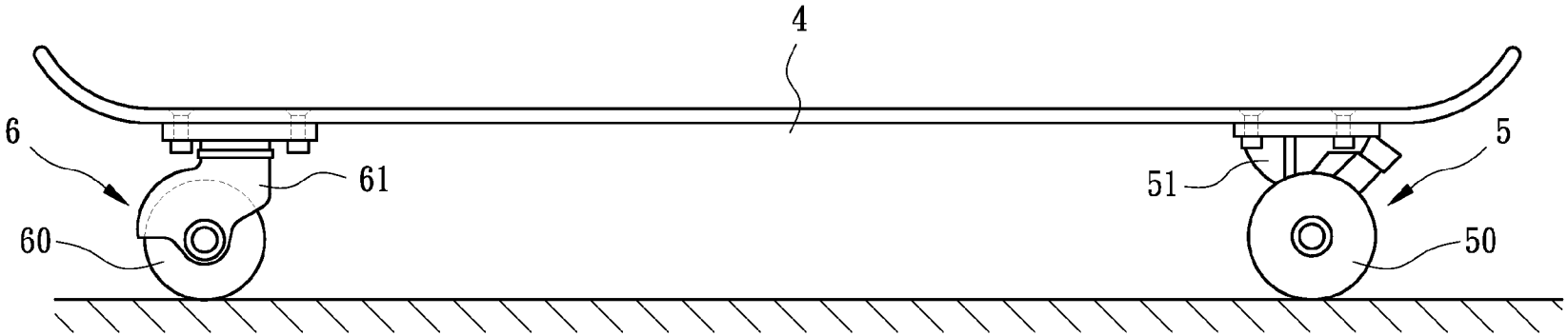
FIG. 5 PRIOR ART
FIG. 5 is a side view of a conventional skateboard shown in FIG. 1.

Referring to FIG. 1, there is shown a skateboard in an inverted position according to the preferred embodiment of the present invention. The skateboard includes a deck 1 made with a nose and a tail, a rear assembly 2 attached to the bottom of the deck 1 near the tail, a front assembly 3 attached to the bottom of the deck 1 near the nose, a post attached to the top of the deck 1 near the nose, and a handle connected to the post.

The rear assembly 2 includes a rear truck attached to the bottom of the deck 1 near the tail of the deck 1 and two rear wheels 20 attached to the rear truck. The rear assembly 2 will not be described in detail for not being the spirit of the present invention.

The front assembly 3 includes a front truck attached to the bottom of the deck 1 and a front wheel 30 attached to the front truck. The front truck includes a base plate 31 attached to the bottom of the deck 1, a hanger or fork 33 for supporting the front wheel 30, a friction-resistant plate 32 located between the base plate 31 and the hanger 33, and a king pin 34 for pivotally connecting the hanger 33 to the base plate 31.

The base plate 31 is made of a hard plastic material. The base plate 31 includes a planar face extending on the top thereof, an inclined face 310 extending on the bottom thereof, and an aperture 311 defined in the inclined face 310. The axis of the aperture 311 extends perpendicular to a plane in which the inclined face 310 lays. The axis of the aperture 311 extends downward and toward the tail of the deck 1 as the base plate 31 is attached to the deck 1.

The friction-resistant plate 32 is made of a friction-resistant metal material. The friction-resistant plate 32 is shaped corresponding to the bottom of the base plate 31. The friction-resistant plate 32 includes an annular lip 322 formed on the top thereof. The annular lip 322 includes a screw hole 321 defined therein axially. The friction-resistant plate 32 is attached to the base plate 31, with the annular lip 322 inserted in the aperture 311.

The hanger 33 includes a ring 330 and two branches 331 extending from the bottom of the ring 330. The ring 330 of course includes an aperture 332 defined therein axially. The branches 331 extend at an angle from the axis of the aperture 332. The front wheel 30 is rotationally connected to the branches 331 by an axle 334.

The king pin 34 includes a screw hole 340 defined therein axially and a thread 341 extending thereon. The thread 341 is a right-hand thread. The king pin 34 is inserted through two bearings 333 located in the ring 330 and a washer 35. The thread 341 is driven in the screw hole 321 to connect the hanger 33 to the friction-resistant plate 32. A screw 312 that is formed with a left-hand thread is driven in the screw hole 340 after it is inserted through the base plate 31, the friction-resistant plate 32 and the ring 330. Thus, the base plate 31, the friction-resistant plate 32 and the hanger 33 are connected to one another. The washer 35 is made with adequate thickness to separate the hanger 33 from the friction-resistant plate 32. Finally, the base plate 31 is attached to the bottom of the deck 1 by screws.

In operation, the rear wheels 20 and the front wheel 30 are laid on the ground or a floor. A user lays a foot on the deck and the other foot on the ground. The user kicks the ground and rides on with the skateboard while holding the handle. To turn, the user tilts his or her body on the skateboard. The hanger 33 rotates relative to the base plate 31 for steering.

The skateboard is made with several advantageous features. At first, the axis of the king pin 34 extends downward and toward the deck 1. Thus, the point of the contact of the front wheel 30 with the ground is closer to the tail of the deck 1 than it is in the prior art. Hence, the steering of the skateboard is more smooth than it is in the prior art.

Secondly, the friction-resistant plate 32 is located between the hanger 33 and the base plate 31. The base plate 31 is protected from the hanger 33. Thus, the skateboard is reliable compared with the prior art.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A skateboard including:

a deck;

a rear assembly attached to the deck; and a front assembly including:

a base plate attached to the deck, made of a plastic material, and formed with an inclined face and an aperture defined in the inclined face;

a friction-resistant plate made of a friction-resistant metal material and located against the inclined face, wherein the friction-resistant plate includes an annular lip located in the aperture and a screw hole defined in the annular lip;

a hanger including a ring and two branches extending from the ring;

a front wheel attached to the branches;

a bearing located in the ring; and a king pin inserted in the bearing, the friction-resistant plate and the base plate so that the axis of the king pin extends downward and toward the rear assembly, wherein the king in includes a thread driven in the screw hole.

2. The skateboard according to claim 1, wherein the front assembly further includes a washer located between the friction-resistant plate and the ring.

3. The skateboard according to claim 2, wherein the washer is made with adequate thickness to keep the friction-resistant plate from the ring.

4. The skateboard according to claim 1, wherein the front assembly further includes a screw, wherein the king pin includes a screw hole for receiving the screw.

5. The skateboard according to claim 4, wherein the thread of the king pin is a right-hand thread, wherein the screw is a left-hand screw.

6. The skateboard according to claim 1, wherein the king pin is inserted in the aperture of the base plate.

* * * * *